US008408141B2

(12) United States Patent
Durante et al.

(10) Patent No.: US 8,408,141 B2
(45) Date of Patent: Apr. 2, 2013

(54) CABLE TRANSPORTATION SYSTEM AND RELATIVE OPERATING METHOD

(75) Inventors: Andrea Durante, Vipiteno (IT); Federico Bavaresco, Fie' Allo Sciliar (IT); Giuseppe Conte, Bolzano (IT)

(73) Assignee: Rolic Invest S.AR.L., Luxembourg (LU)

( * ) Notice: Subject to any disclaimer, the term of this patent is extended or adjusted under 35 U.S.C. 154(b) by 202 days.

(21) Appl. No.: 12/739,901

(22) PCT Filed: Oct. 24, 2008

(86) PCT No.: PCT/EP2008/064491

§ 371 (c)(1),
(2), (4) Date: Jun. 23, 2010

(87) PCT Pub. No.: WO2009/053485

PCT Pub. Date: Apr. 30, 2009

(65) Prior Publication Data

US 2010/0294162 A1 Nov. 25, 2010

(30) Foreign Application Priority Data

Oct. 26, 2007 (IT) ..... MI2007A2071

(51) Int. Cl.
*B61B 12/00* (2006.01)

(52) U.S. Cl. ..... 104/173.1

(58) Field of Classification Search ..... 104/112, 104/117, 165, 173.1, 174, 178, 180, 193, 104/197–200

See application file for complete search history.

(56) References Cited

U.S. PATENT DOCUMENTS

| | | | | |
|---|---|---|---|---|
| 472,211 | A | 4/1892 | Fralinger | |
| 1,944,446 | A | 1/1934 | McGowen | |
| 2,662,587 | A | 12/1953 | McIlvaine | |
| 2,710,650 | A | 6/1955 | Sowder | |
| 2,985,224 | A | 5/1961 | Sowder | |
| 3,170,412 | A | 2/1965 | Sowder | |
| 3,854,421 | A * | 12/1974 | Widiger et al. | 105/275 |
| 3,934,517 | A | 1/1976 | Hirsig | |
| 4,185,562 | A | 1/1980 | Hatori et al. | |
| 4,226,187 | A | 10/1980 | Paulsen et al. | |
| 4,269,123 | A | 5/1981 | Segafredo | |
| 4,280,411 | A | 7/1981 | Katayose et al. | |
| 4,462,314 | A | 7/1984 | Kunczynski | |
| 4,470,355 | A | 9/1984 | Kunczynski | |
| 4,473,011 | A | 9/1984 | Wuschek | |
| 4,640,197 | A | 2/1987 | Brian | |
| 4,641,587 | A | 2/1987 | Dalliard | |

(Continued)

FOREIGN PATENT DOCUMENTS

| | | |
|---|---|---|
| AT | 315910 | 6/1974 |
| AT | 342655 | 4/1978 |

(Continued)

*Primary Examiner* — Robert McCarry, Jr.
(74) *Attorney, Agent, or Firm* — Neal, Gerber & Eisenberg LLP

(57) ABSTRACT

A cable transportation system having a pull cable defined by a number of strands and drawn along a path; at least one transportation unit movable along the path and connected to the pull cable by a coupling device; a metal structure located along the path to support and guide the transportation unit; and at least one guide roller for guiding the pull cable and supported by the metal structure by leaf springs which reduce vibration caused by the strands of the pull cable contacting the guide roller.

14 Claims, 4 Drawing Sheets

U.S. PATENT DOCUMENTS

| | | | |
|---|---|---|---|
| 4,671,187 | A | 6/1987 | Kunczynski |
| 4,833,997 | A | 5/1989 | Cathiard |
| 4,898,100 | A | 2/1990 | Brochand |
| 5,107,771 | A | 4/1992 | Kainz |
| 5,113,768 | A | 5/1992 | Brown |
| 5,226,368 | A | 7/1993 | Brochand et al. |
| 5,515,789 | A | 5/1996 | Brochand et al. |
| 5,562,040 | A | 10/1996 | Egli |
| 5,582,109 | A | 12/1996 | Levi et al. |
| 5,595,122 | A | 1/1997 | Levi et al. |
| 6,036,282 | A | 3/2000 | Clarke et al. |
| 6,345,578 | B1 | 2/2002 | Pabst |
| 6,543,366 | B2 | 4/2003 | Pabst et al. |
| 6,585,232 | B2 | 7/2003 | Rechenmacher |
| 7,410,068 | B1 | 8/2008 | Andreetto |
| 7,549,377 | B2 | 6/2009 | Pabst |
| 2002/0026839 | A1 | 3/2002 | Lehtovaara |
| 2002/0088368 | A1 | 7/2002 | Pabst et al. |
| 2006/0249718 | A1 | 11/2006 | Levi |
| 2007/0169660 | A1 | 7/2007 | Pabst |
| 2008/0115689 | A1 | 5/2008 | Heil et al. |
| 2009/0165666 | A1 | 7/2009 | Pabst et al. |
| 2009/0165668 | A1 | 7/2009 | Andreetto |

FOREIGN PATENT DOCUMENTS

| | | |
|---|---|---|
| AT | 373832 | 2/1984 |
| AT | 388146 | 5/1989 |
| AT | 390926 | 7/1990 |
| CH | 259291 | 1/1949 |
| CH | 360704 | 3/1962 |
| CH | 554761 | 10/1974 |
| DE | 423865 | 1/1926 |
| DE | 2020746 | 12/1971 |
| DE | 2101743 | 9/1972 |
| DE | 3109294 | 10/1982 |
| DE | 3834116 | 5/1989 |
| DE | 3927757 | 3/1991 |
| DE | 4127373 | 2/1993 |
| EP | 0055955 | 7/1982 |
| EP | 0135239 | 3/1985 |
| EP | 0218306 | 4/1987 |
| EP | 0218897 | 4/1987 |
| EP | 0281205 | 9/1988 |
| EP | 0491632 | 6/1992 |
| EP | 0517622 | 12/1992 |
| EP | 0613807 | 9/1994 |
| EP | 0640518 | 3/1995 |
| EP | 0678433 | 10/1995 |
| EP | 0687607 | 12/1995 |
| EP | 0692418 | 1/1996 |
| EP | 0745526 | 12/1996 |
| EP | 0970864 | 1/2000 |
| EP | 1077167 | 2/2001 |
| EP | 1088729 | 4/2001 |
| EP | 1174323 | 1/2002 |
| EP | 1195305 | 4/2002 |
| EP | 1209055 | 5/2002 |
| EP | 1331151 | 7/2003 |
| EP | 1364853 | 11/2003 |
| EP | 1419950 | 5/2004 |
| FR | 891743 | 3/1944 |
| FR | 913146 | 8/1946 |
| FR | 1100001 | 9/1955 |
| FR | 1199721 | 12/1959 |
| FR | 1423648 | 1/1966 |
| FR | 2340895 | 9/1977 |
| FR | 2387830 | 11/1978 |
| FR | 2391450 | 12/1978 |
| FR | 2392858 | 12/1978 |
| FR | 2562857 | 10/1985 |
| FR | 2670452 | 6/1992 |
| FR | 2706404 | 12/1994 |
| FR | 2823482 | 10/2002 |
| FR | 2867142 | 9/2005 |
| GB | 1326264 | 8/1973 |
| GB | 1353030 | 5/1974 |
| GB | 1460106 | 12/1976 |
| GB | 2017024 | 9/1979 |
| WO | WO2004067347 | 8/2004 |
| WO | WO2004085221 | 10/2004 |
| WO | WO2005032901 | 4/2005 |
| WO | WO2008020021 | 2/2008 |
| WO | WO2008129017 | 10/2008 |
| WO | WO2008129019 | 10/2008 |
| WO | WO2009019259 | 2/2009 |

* cited by examiner

CABLE TRANSPORTATION SYSTEM AND RELATIVE OPERATING METHOD

PRIORITY CLAIM

This application is a national stage application of PCT/EP2008/064491, filed Oct. 24, 2008, which claims the benefit of and priority to Italian Patent Application No. MI2007A 002071, filed on Oct. 26, 2007, the entire contents of which are incorporated herein.

TECHNICAL FIELD

The present disclosure relates to a cable transportation system.

More specifically, the present disclosure relates to a cable transportation system comprising a pull cable defined by a number of strands and drawn along a path; at least one transportation unit movable along the path and connectable to the pull cable by a coupling device; a metal structure placed along the path to support and guide the transportation unit; and at least one pull cable guide roller supported by the metal structure.

BACKGROUND

Known cable transportation systems are substantially rail-mounted that extend along paths with bends and varying in height.

For example, a cable transportation system is described in European Patent No. 0 687 607 B1. Guiding the pull cable around bends and along different heights calls for guide rollers that are normally supported by a normally concrete foundation structure.

Sometimes, however, the path comprises portions with no foundation, as in the case of bridges. In these situations, the guide rollers must be connected to the metal structure of the bridge or to the rails themselves.

This technical solution may pose various environmental problems, on account of the noise generated by the metal structure.

This drawback may also prevent development of cable transportation technology in urban environments, as, for example, along elevated metal structures.

SUMMARY

It is an object of the present disclosure to provide a cable transportation system configured to eliminate certain of the above-described drawbacks of known cable transportation systems.

According to the present disclosure, there is provided a cable transportation system, characterized in that the guide roller is connected to the metal structure by leaf springs which reduce or dampen vibration caused by contact between the strands of the pull cable and the guide roller.

Additional features and advantages are described in, and will be apparent from, the following Detailed Description and the figures.

BRIEF DESCRIPTION OF THE DRAWINGS

A number of non-limiting embodiments of the present disclosure will be described by way of example with reference to the accompanying drawings, in which.

DETAILED DESCRIPTION

Figure 1:
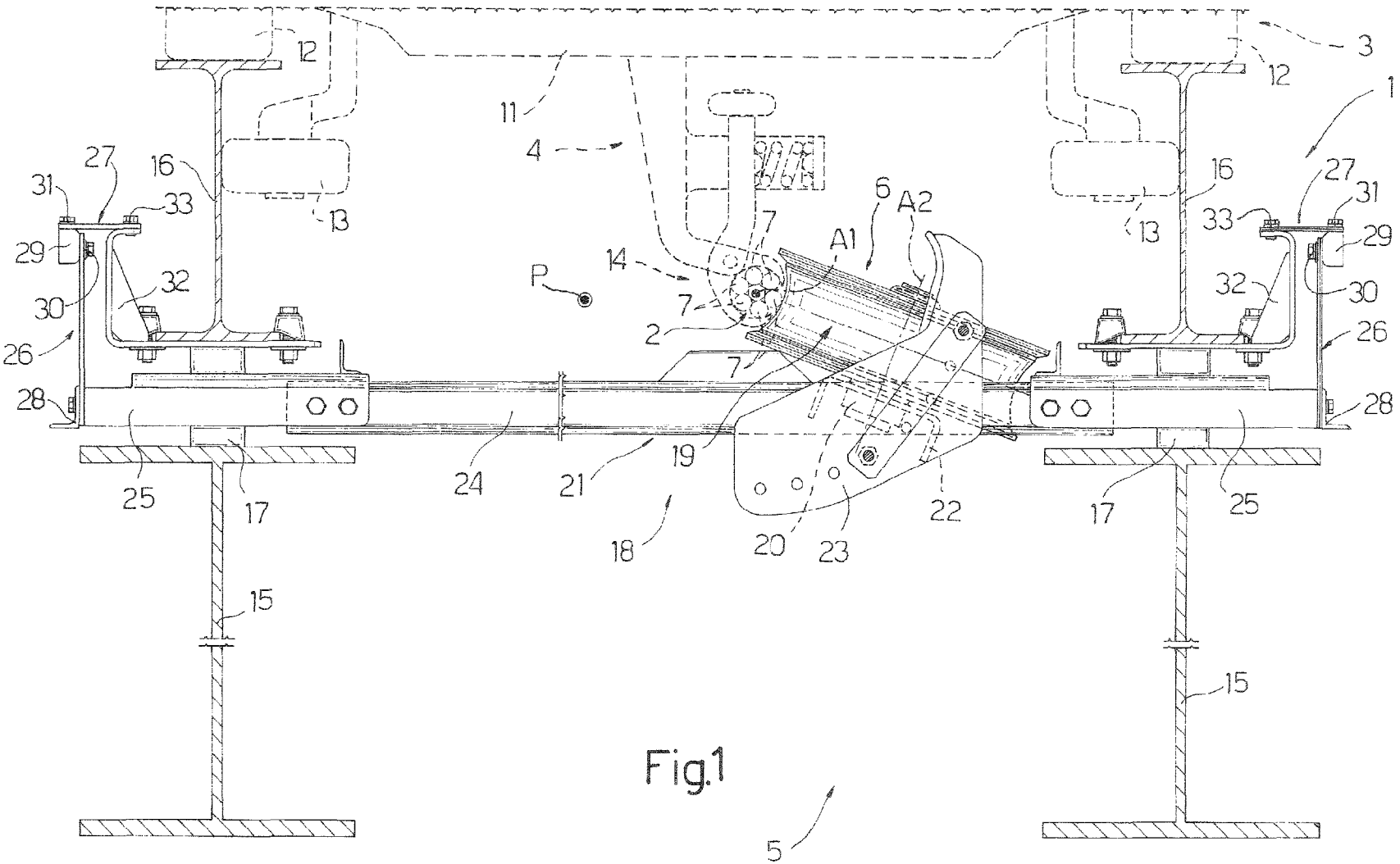
FIG. 1 shows a partly sectioned front view, with parts removed for clarity, of a cable transportation system in accordance with the present disclosure.

Referring now to the example embodiments of the present disclosure illustrated in FIGS. 1 to 5, number 1 in FIG. 1 indicates a passenger cable transportation system. In the FIG. 1 example, cable transportation system 1 comprises a pull cable 2 drawn at substantially constant speed along a path P; at least one transportation unit 3 connectable selectively to pull cable 2 by a coupling device 4; a metal structure 5 for supporting and guiding transportation unit 3; and at least one guide roller 6 for guiding pull cable 2 and supported by metal structure 5.

Figure 2:
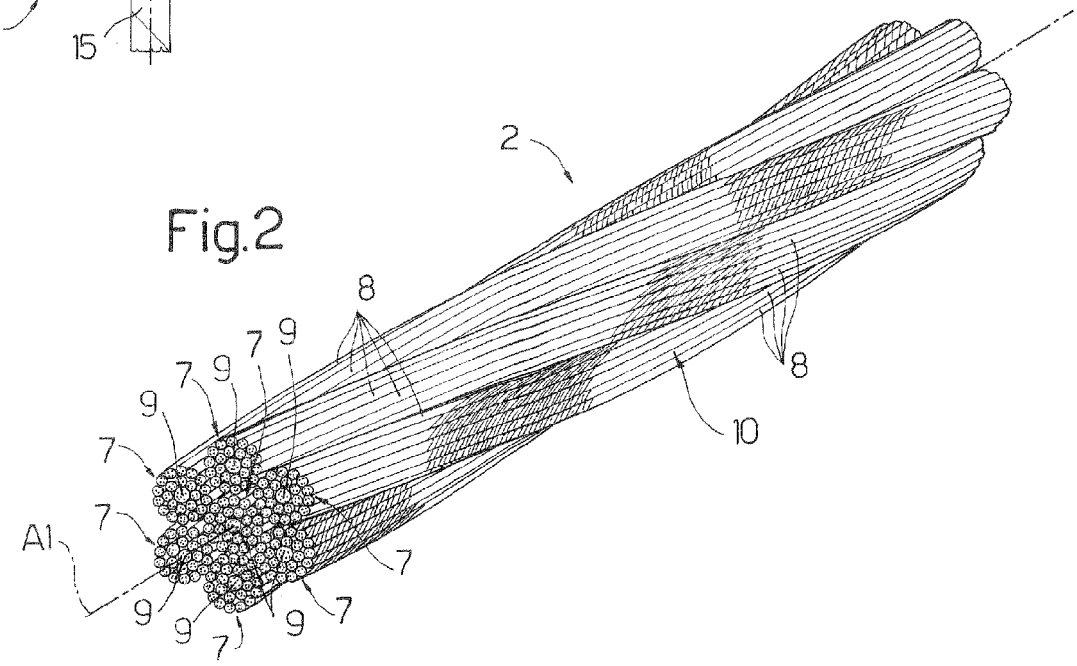
FIG. 2 shows a larger-scale, partly sectioned view in perspective, with parts removed for clarity, of the pull cable of the FIG. 1 system.

With reference to FIG. 2, pull cable 2 extends along an axis A1, and is defined by a number of strands 7 twisted about axis A1. Each strand 7 is in turn defined by a number of metal wires 8 twisted about a non-metal core 9, with the result that pull cable 2 has an outer surface 10 characterized by successive dips and ridges at regular intervals.

With reference to FIG. 1, transportation unit 3 comprises a frame 11; two supporting wheels 12 resting on metal structure 5; two control wheels 13 controlling wheels 12; and coupling device 4, which comprises a clamp 14 for selectively connecting and releasing transportation unit 3 to and from pull cable 2, as described in detail in European Patent Numbers 1 077 167 B1 and 0 687 607 B1.

In another embodiment (not shown in the drawings), transportation unit 3 is fixed to pull cable 2 by a non-releasable clamp (i.e., as typically employed in a back-and-forth transportation system).

Metal structure 5 comprises two beams 15 substantially parallel to path P and defining construction members of a complex elevated structure; and two further beams 16, each substantially parallel to path P and resting on a respective beam 15 by means of spacers 17 distributed along path P. In other words, further beams 16 define the rails on which transportation unit 3 rests.

Guide roller 6 is connected to metal structure 5 by a frame 18 which, in the example shown, is fixed to beams 16. In another embodiment (not shown in the drawings), frame 18 is fixed to beams 15.

Guide roller 6 rotates about an axis A2, and comprises an annular groove 19 for housing pull cable 2; and a pin 20, of axis A2, supported rigidly by frame 18.

Figure 3:
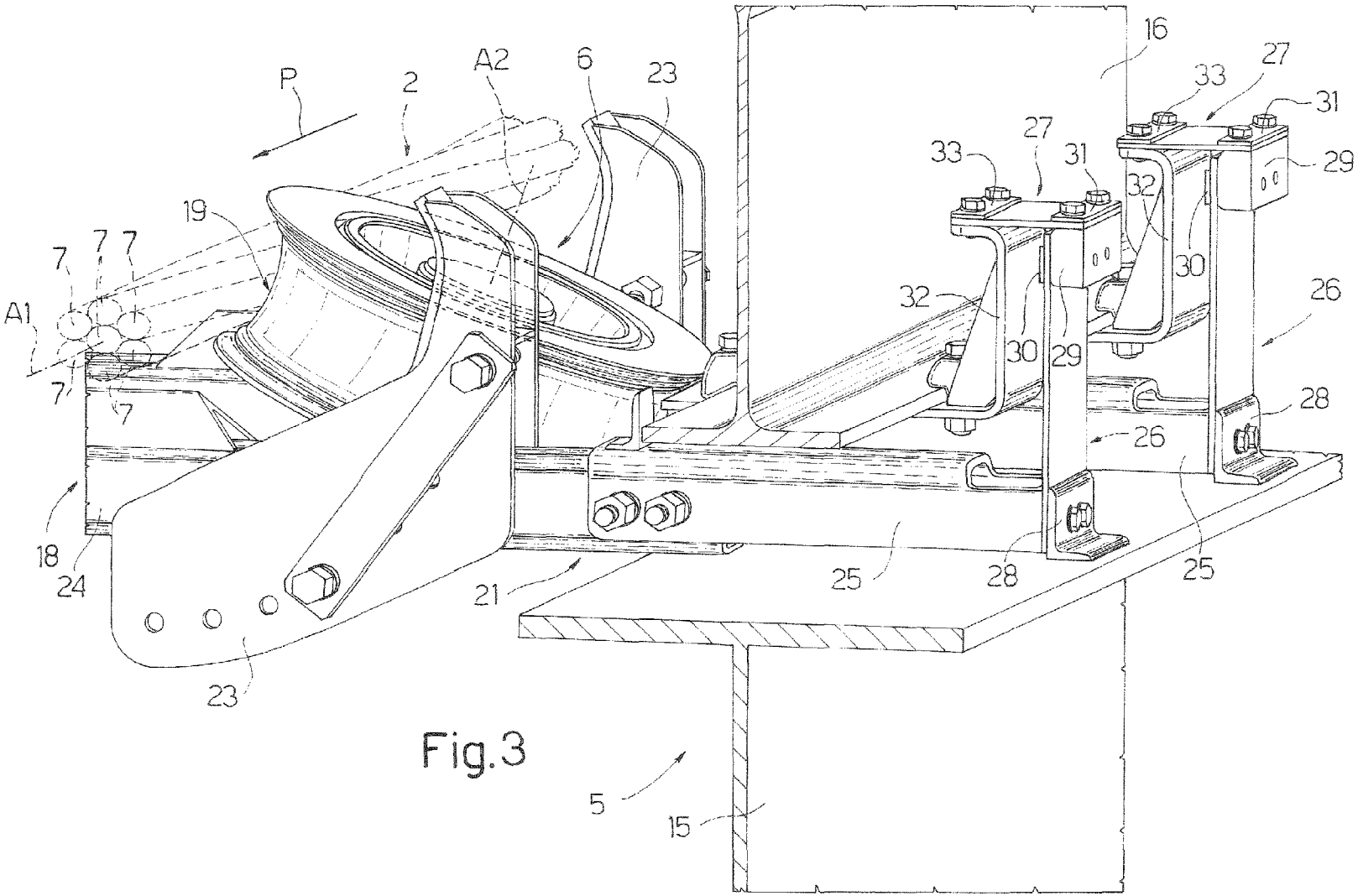
FIG. 3 shows a larger-scale view in perspective, with parts removed for clarity, of a detail of the FIG. 1 cable transportation system.

With reference to FIG. 3, frame 18 comprises two parallel cross members 21 crosswise to beams 15; a bar 22 (FIG. 1) rigidly supporting pin 20 (FIG. 1) and substantially parallel to beams 15; and two pairs of flanges 23 by which to fix bar 22 to cross members 21. The position of flanges 23 with respect to cross members 21 is adjustable to adjust the tilt of bar 22 and therefore of axis A2, and to adjust the position of bar 22 in a direction parallel or crosswise to cross members 21. Each cross member 21 comprises a central portion 24; and two end portions 25 connected telescopically to central portion 24 and fixed to central portion 24 by fasteners, such as screws. Each cross member 21 is longer than the distance between beams 15 and beams 16 (i.e., is longer than the distance between the rails).

Each end portion 25 of cross member 21 is fixed to beam 16 by two leaf springs 26, 27 perpendicular to each other. In the FIGS. 1 and 3 example, leaf spring 26 is substantially vertical and perpendicular to cross member 21, and leaf spring 27 is substantially horizontal and parallel to cross member 21.

Leaf spring 26 has a first end gripped between the end of cross member 21 and a flange 28; and a second end gripped between a block 29 and a flange 30.

Leaf spring 27 has a first end gripped between block 29 and a flange 31; and a second end gripped between a bracket 32 and a flange 33. Bracket 32 is C-shaped and connected rigidly to beam 16.

Figure 4:
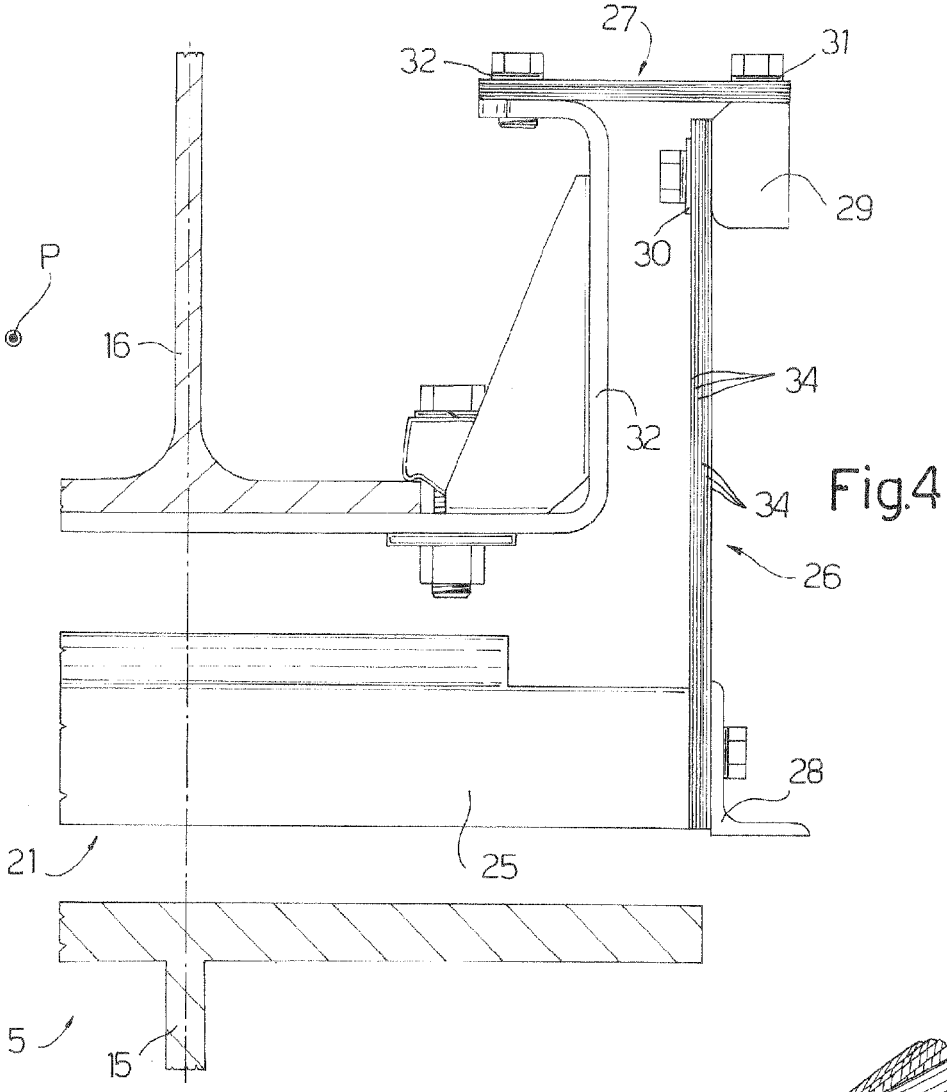
FIG. 4 shows a partly sectioned front view, with parts removed for clarity, of a variation of the present disclosure.

With reference to FIG. 4, each leaf spring 26, 27 is made of a number of packed spring steel plates 34.

With reference to FIG. 3, the length of each leaf spring 26, 27 is chosen as a function of the tilt of axis A2 of guide roller 6, and of the loads transmitted by pull cable 2 to guide roller 6. The tilt of axis A2 is in turn chosen as a function of path P of pull cable 2. Using leaf springs 26, 27 of different lengths is made possible by frame 18: both the length of cross members 21 and the position of guide roller 6 with respect to cross members 21 are adjustable.

In certain embodiments, one of leaf springs 26, 27 may not be needed and may even be eliminated.

Figure 5:
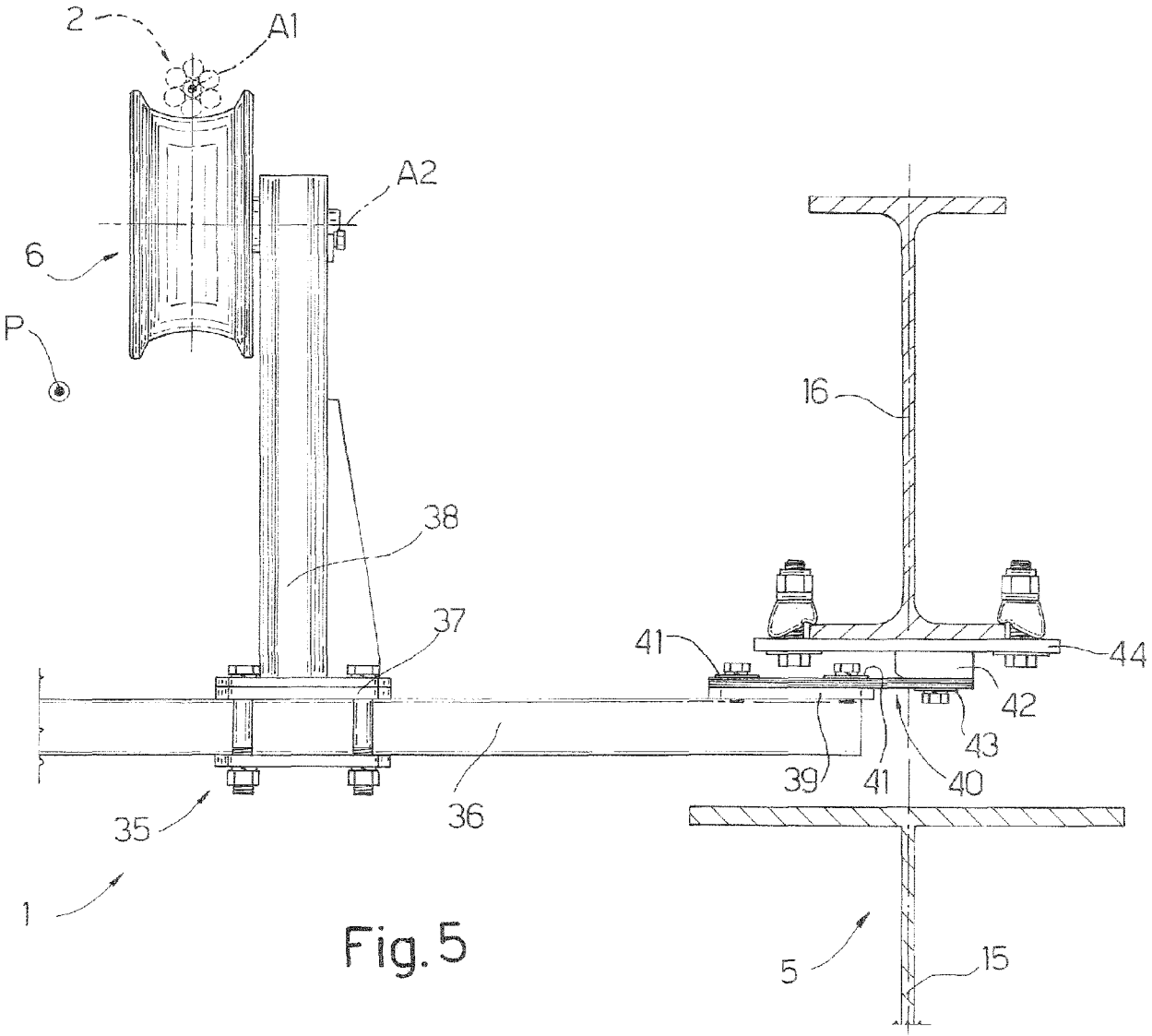
FIG. 5 shows a larger-scale, partly sectioned front view, with parts removed for clarity, of a variation of the FIG. 1 transportation system.

In the FIG. 5 variation, vertical leaf springs 26 are eliminated.

More specifically, the embodiment of FIG. 5 shows a frame 35 for supporting guide roller 6 positioned, in the example shown, with its axis A2 horizontal and substantially crosswise to path P. Frame 35 comprises a cross member 36; a plate 37 for adjusting the height of guide roller 6; and an upright 38 integral with pin 20 of guide roller 6.

Cross member 36 is located beneath beams 16, is equal in length to the distance between beams 16 (the rails), and has two ends, each of which is fixed to a respective flange 39 facing the underside of beam 16, and is connected to beam 16 by a substantially horizontal leaf spring 40.

Leaf spring 40 is substantially parallel also to axis A1 of cable 2, and has one end fixed to flange 39 by a flange 41 and fasteners, such as screws, and one end gripped between a spacer 42 and a flange 43. Spacer 42 is integral with a bracket 44 anchored to beam 16.

Leaf spring 40 is also made of packed spring steel plates 34.

Tests conducted by the Applicant show leaf springs 26, 27, 40, made of spring steel (harmonic steel) plates 34, reduce noise to such a relatively low level as not to cause harm or discomfort to people in the vicinity of cable transportation system 1.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A cable transportation system comprising:

a pull cable defined by a plurality of strands and configured to be drawn along a path;

at least one transportation unit configured to move along the path and connectable to the pull cable by a coupling device;

a structure located along the path and configured to support and guide the at least one transportation unit;

a guide roller supported by the structure and configured to guide the pull cable, wherein the guide roller is connected to the structure by a plurality of leaf springs configured to reduce vibration caused by contact between the plurality of strands of the pull cable and the guide roller; and a frame supporting the guide roller, said frame being connected to the structure by the leaf springs.

2. The cable transportation system of claim 1, wherein the structure includes two beams substantially parallel to the pull cable, and the frame includes at least one cross member crosswise to the two beams, said at least one cross member having two ends which are each connected to the beams by at least one of the leaf springs.

3. The cable transportation system claim 1, wherein the guide roller is configured to rotate about an inclined axis, the structure includes two beams substantially parallel to the pull cable, and the frame includes a cross member crosswise to the two beams, said cross member having two ends which are each connected to the beams by a first one of the leaf springs positioned in a first direction and by a second one of the leaf springs positioned in a second, different direction, the second one of the leaf springs connected in series to the first one of the leaf springs.

4. The cable transportation system of claim 3, wherein the first one of the leaf springs is a substantially vertically extending leaf spring and the second one of the leaf springs is a substantially horizontally extending leaf spring.

5. The cable transportation system of claim 3, wherein the cross member includes a central portion and two end portions adjustable with respect to the central portion to adjust the length of the cross member.

6. The cable transportation system of claim 3, wherein the guide roller is adjustably fixed to the cross member to adjust: (i) the tilt of the axis of the guide roller, and (ii) the position of the guide roller with respect to the cross member.

7. The cable transportation system of claim 1, wherein the guide roller is configured to rotate about an axis, the structure includes two beams substantially parallel to the pull cable, and the frame includes a cross member crosswise to the two beams, said cross member having two ends which are each connected to the beams by one of the leaf springs parallel to the axis.

8. The cable transportation system of claim 7, wherein the axis and the one leaf spring are substantially horizontal.

9. The cable transportation system of claim 1, wherein the plurality of leaf springs each include a plurality of packed steel plates.

10. The cable transportation system of claim 1, wherein each of the plurality of leaf springs are made of spring steel.

11. The cable transportation system of claim 1, wherein the structure is a metal structure.

12. The cable transportation system of claim 1, which includes a plurality of guide rollers, each of said guide rollers supported by the structure and configured to guide the pull cable, each of the guide rollers are connected to the structure by a plurality of leaf springs configured to reduce vibration caused by contact between the plurality of strands of the pull cable and said guide roller.

13. The cable transportation system claim 1, wherein a first one of the leaf springs is positioned in a first direction, a second one of the leaf springs is positioned in a second, different direction and the second one of the leaf springs is connected in series to the first one of the leaf springs.

14. The cable transportation system of claim 13, wherein the first one of the leaf springs is a substantially vertically extending leaf spring and the second one of the leaf springs is a substantially horizontally extending leaf spring.

* * * * *